US006837382B2

(12) United States Patent
Chen

(10) Patent No.: US 6,837,382 B2
(45) Date of Patent: Jan. 4, 2005

(54) HANGER FOR WRENCHES

(76) Inventor: Terence Chen, No. 325, Yung Ching Rd., Tung Shan Hsiang, Lo Tung Town, Yi Lan Hsien (TW)

( * ) Notice: Subject to any disclaimer, the term of this patent is extended or adjusted under 35 U.S.C. 154(b) by 0 days.

(21) Appl. No.: 10/307,741

(22) Filed: Dec. 2, 2002

(65) Prior Publication Data

US 2004/0089620 A1 May 13, 2004

(30) Foreign Application Priority Data

Nov. 7, 2002 (TW) ..... 91218039 U

(51) Int. Cl.[7] ..... A47F 7/00
(52) U.S. Cl. ..... 211/70.6
(58) Field of Search ..... 211/70.6, 13.1, 211/60.1, 71.01; 206/376

(56) References Cited

U.S. PATENT DOCUMENTS 6,202,864 B1 * 3/2001 Ernst et al. ..... 211/70.6
6,257,409 B1 * 7/2001 Lin ..... 206/376
6,315,121 B1 * 11/2001 Hansen ..... 206/376
6,360,892 B1 * 3/2002 Chen ..... 206/376
6,536,611 B2 * 3/2003 Chen ..... 211/70.6
6,637,606 B1 * 10/2003 Chen ..... 211/70.6
6,679,391 B1 * 1/2004 Huang ..... 211/70.6

* cited by examiner

*Primary Examiner*—Hugh B. Thompson, II
*Assistant Examiner*—Sarah Purol
(74) *Attorney, Agent, or Firm*—Alan D. Kamrath; Nikolai & Mersereau, P.C.

(57) ABSTRACT

A hanger includes a board and a cover for covering the board. The board includes at least one recess defined in a front face for receiving a wrench, at least one holder elastically and pivotally mounted in the at least one recess for holding the wrench, and two holes each defined in a side. The cover includes two hooks formed thereon for insertion in the holes for retaining the board engaged with the cover. The at least one holder includes a stop formed thereon for restricting the wrench. The at least one recess is defined between two sidewalls one of which defines a hole in which the at least one holder is located. The hole defined in the one of the sidewalls includes an upper edge and a lower edge. The at least one holder includes an upper edge connected with the upper edge of the hole defined in the one of the sidewalls and a lower edge connected with lower edge of the hole defined in the one of the sidewalls. The hanger includes a joint formed between the upper edge of the at least one holder and the upper edge of the hole defined in the one of the sidewalls. The hanger includes a joint formed between the lower edge of the at least one holder and the lower edge of the hole defined in the one of the sidewalls.

20 Claims, 8 Drawing Sheets

HANGER FOR WRENCHES

BACKGROUND OF INVENTION

1. Field of Invention

The present invention relates to a hanger for wrenches.

2. Related Prior Art

Taiwan Patent Publication No. 319154 discloses a conventional hanger for wrenches. The hanger 10 includes a board 11 and a series of holders 14 formed on the board 11. Each of the holders 14 consists of two prongs extending from the board 11 towards each other, thus defining a space 15 between the prongs and a slit 16 between the tips of the prongs. A series of holders 14 is dimensioned for a series of wrenches dimensioned in the metric or American system. However, a series of holders 14 dimensioned in the metric system cannot adequately hold a series of wrenches dimensioned in the American system.

The present invention is therefore intended to obviate or at least alleviate the problem encountered in the prior art.

SUMMARY OF INVENTION

It is the primary objective of the present invention to provide a hanger for holding wrenches dimensioned in different metrological systems.

According to the present invention, a hanger includes a board and a cover for covering the board. The board includes at least one recess defined in a front face for receiving a wrench, at least one holder elastically and pivotally mounted thereon in the at least one recess for holding the wrench, and two holes each defined in a side. The cover includes two hooks formed thereon for insertion in the holes for retaining the board engaged with the cover. The at least one holder includes a stop formed thereon for restricting the wrench. The at least one recess is defined between two sidewalls one of which defines a hole in which the at least one holder is located. The hole defined in the one of the sidewalls includes an upper edge and a lower edge. The at least one holder includes an upper edge connected with the upper edge of the hole defined in the one of the sidewalls and a lower edge connected with lower edge of the hole defined in the one of the sidewalls. The hanger includes a joint formed between the upper edge of the at least one holder and the upper edge of the hole defined in the one of the sidewalls. The hanger includes a joint formed between the lower edge of the at least one holder and the lower edge of the hole defined in the one of the sidewalls.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF EMBODIMENTS

Figure 1:
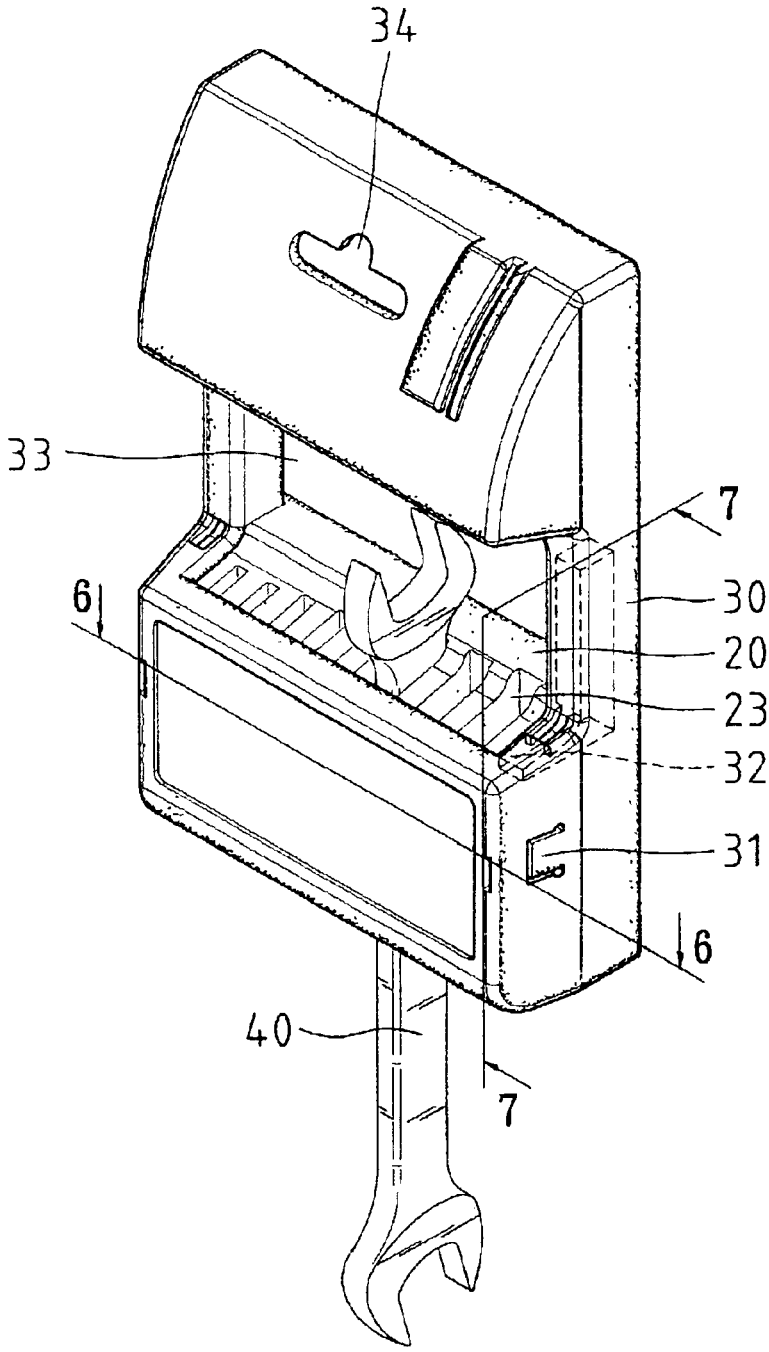
FIG. 1 is a perspective view of a hanger for wrenches according to an embodiment of the present invention.
Figure 2:
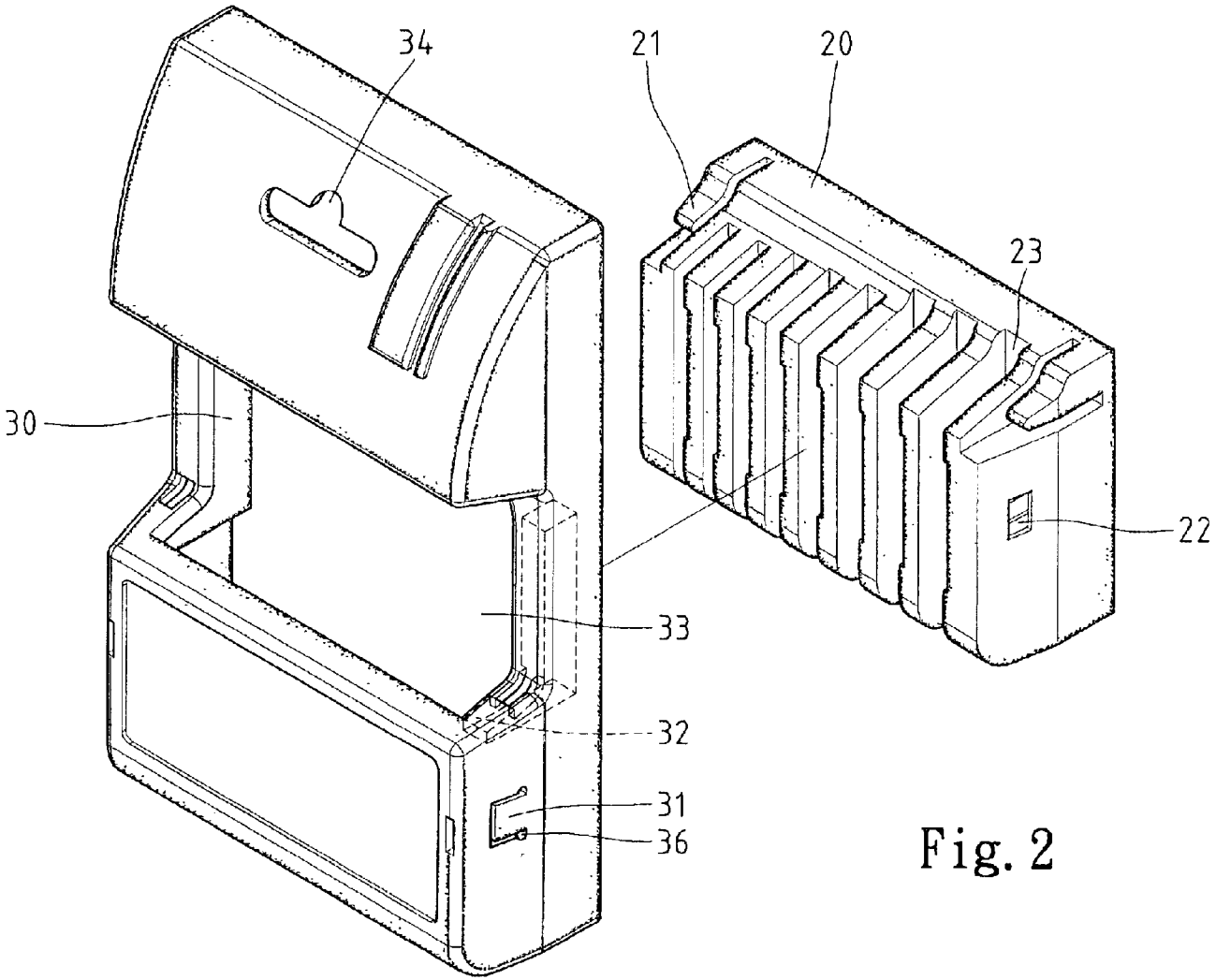
FIG. 2 is an exploded view of the hanger shown in FIG. 1, showing the hanger to include a board and a cover.
Figure 3:
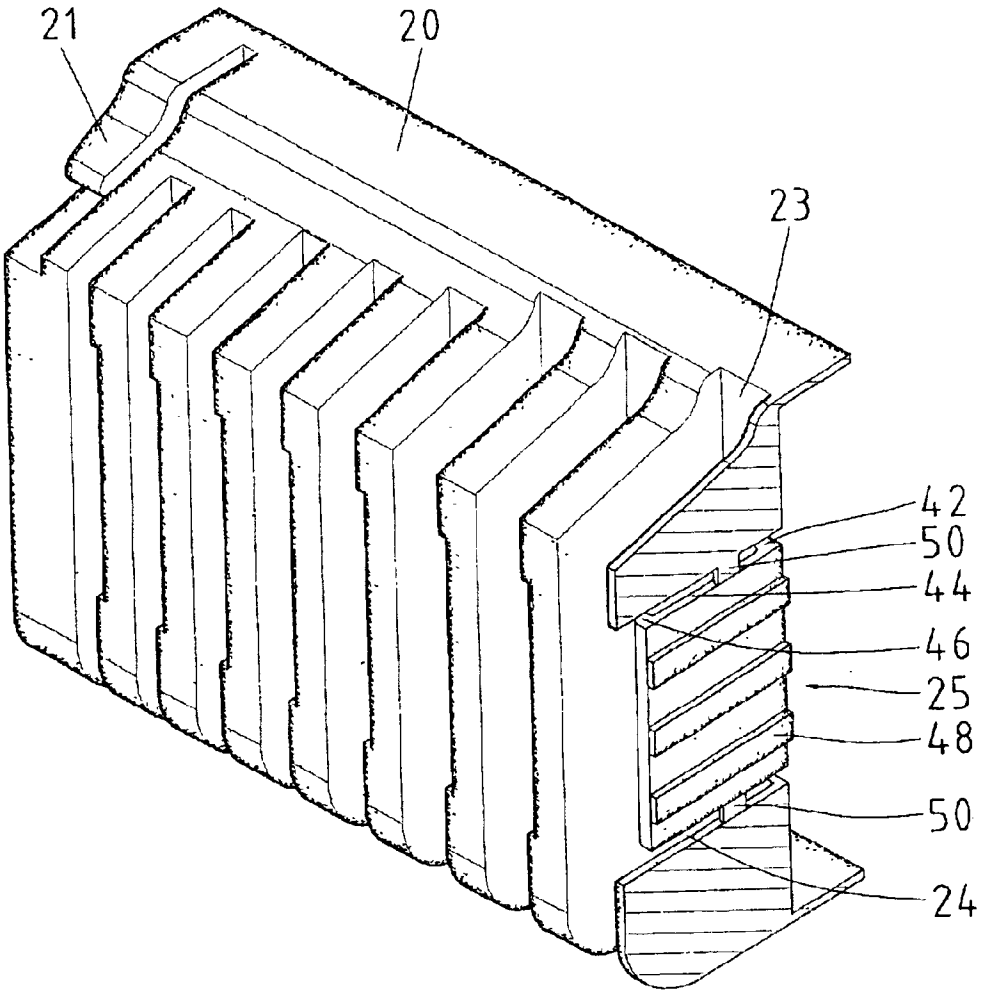
FIG. 3 is a perspective view of the board shown in FIG. 2.

Referring to FIGS. 1–3, according to an embodiment of the present invention, a hanger for wrenches includes a board 20 and a cover 30 on which the board 20 is mounted for retaining wrenches between them.

The board 20 is made of an adequate thickness. The board 20 includes a front face from which two rods 21 extend and two opposite sides in each of which a hole 22 is defined. A series of recesses 23 is defined in the front face of the board 20. Each of the recesses 23 is defined between two sidewalls in one of which a hole 24 is defined between upper and lower edges. A holder 25 is located in each of the holes 24. Each of the holders 25 includes a short portion 42, a long portion 44 extending from the short portion 42, a stop 46 formed on a side of the long portion 44 and some ribs 48 formed on an opposite side of the long portion 44 for reinforcement of the long portion 44. A joint 50 is formed between the upper edge of each of the holes 24 and an upper edge of each of the holders 25. A joint 50 is formed between the lower edge of each of the holes 24 and a lower edge of each of the holders 25.

The cover 30 includes a lower portion, a central portion and an upper portion. The lower portion of the cover 30 includes two sidewalls. A hook 31 is formed on an internal face of each of the sidewalls of the lower portion of the cover 30. To render the each of the hooks 31 flexible, a U-shaped slit 36 is cut in each of the sidewalls of the lower portion of the cover 30. Two holes 32 are defined in the lower portion of the cover 30. An opening 33 is defined in the central portion of the cover 30. A hole 34 is defined in the upper portion of the cover 30 so that the cover 30 can be hung on a nail mounted on a wall.

Figure 4:
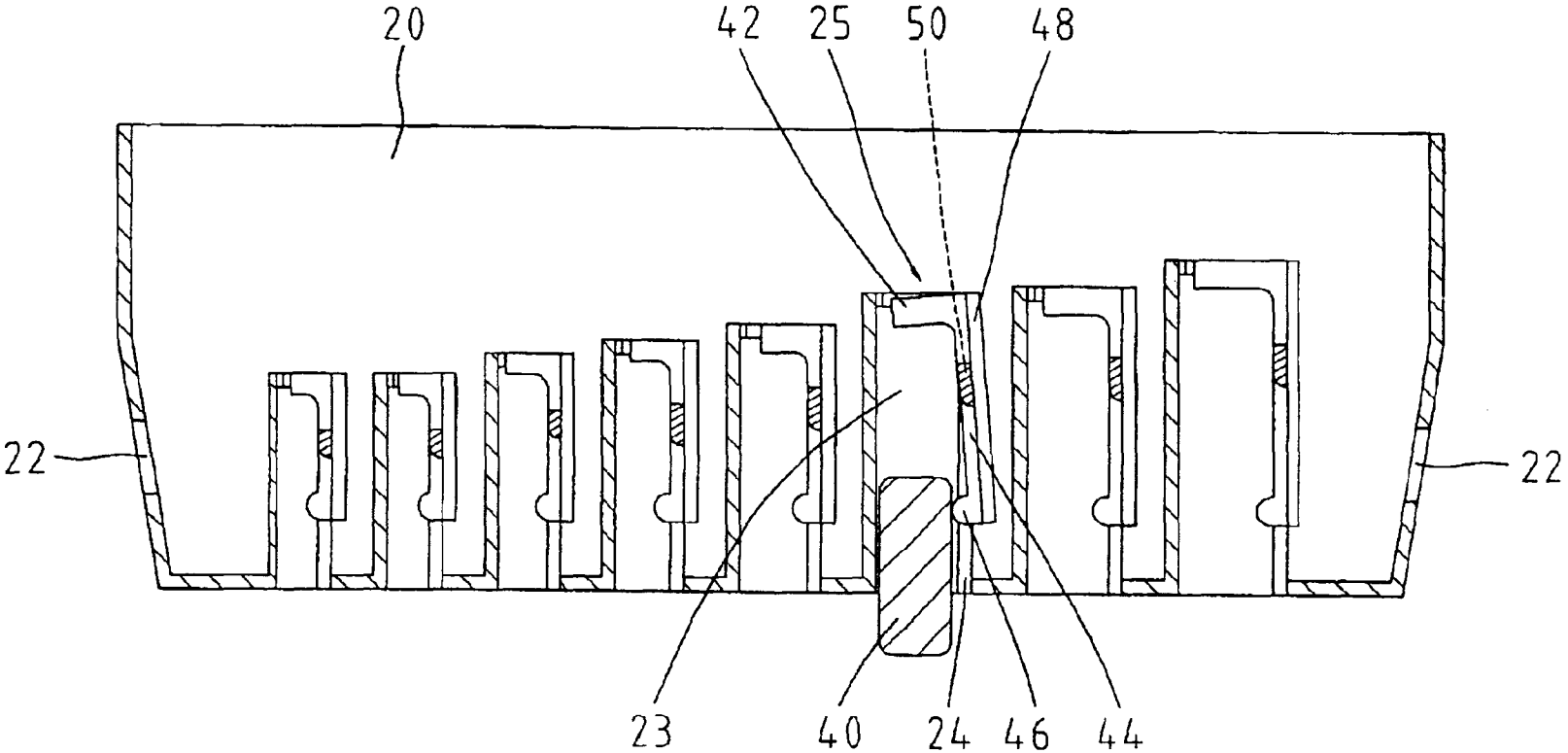
FIGS. 4 and 5 are cross-sectional views of the board shown in FIG. 2.

FIG. 4 shows how to insert a wrench 40 in one of the recesses 23. The wrench 40 includes a leading edge and a trailing edge. The width of the wrench 40 is the distance between the leading edge and the trailing edge. The leading edge of the wrench 40 is forced past the stop 46. The joints 50 exhibit flexibility for allowing movement of the holder 25.

Figure 5:
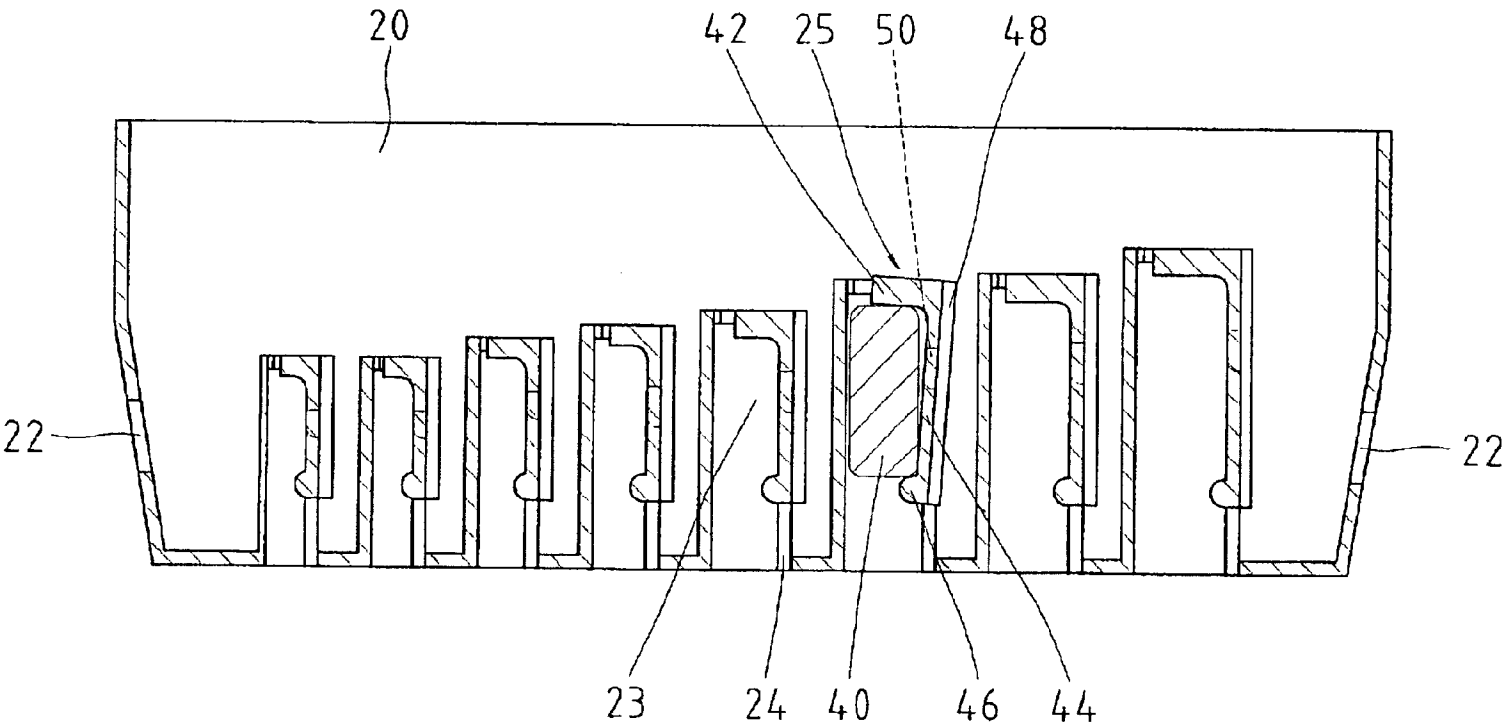

Referring to FIG. 5, if a wrench 40 of a width greater than the distance between the short portion 42 and the long portion 44 is inserted in the recess 23, the leading edge of the wrench 40 will contact the short portion 42 of the holder 25, and the tailing trailing edge of the wrench 40 will contact the stop 46. Thus, the wrench 40 is held between one of the sidewalls of the recess 23 and the holder 25.

If a wrench 40 of a width smaller than the distance between the short portion 42 and the long portion 44 is inserted in the recess 23, a face of the wrench 40 will contact the long portion 44. Thus, the wrench 40 is sandwiched between one of the sidewalls of the recess 23 and the holder 25.

Figure 6:
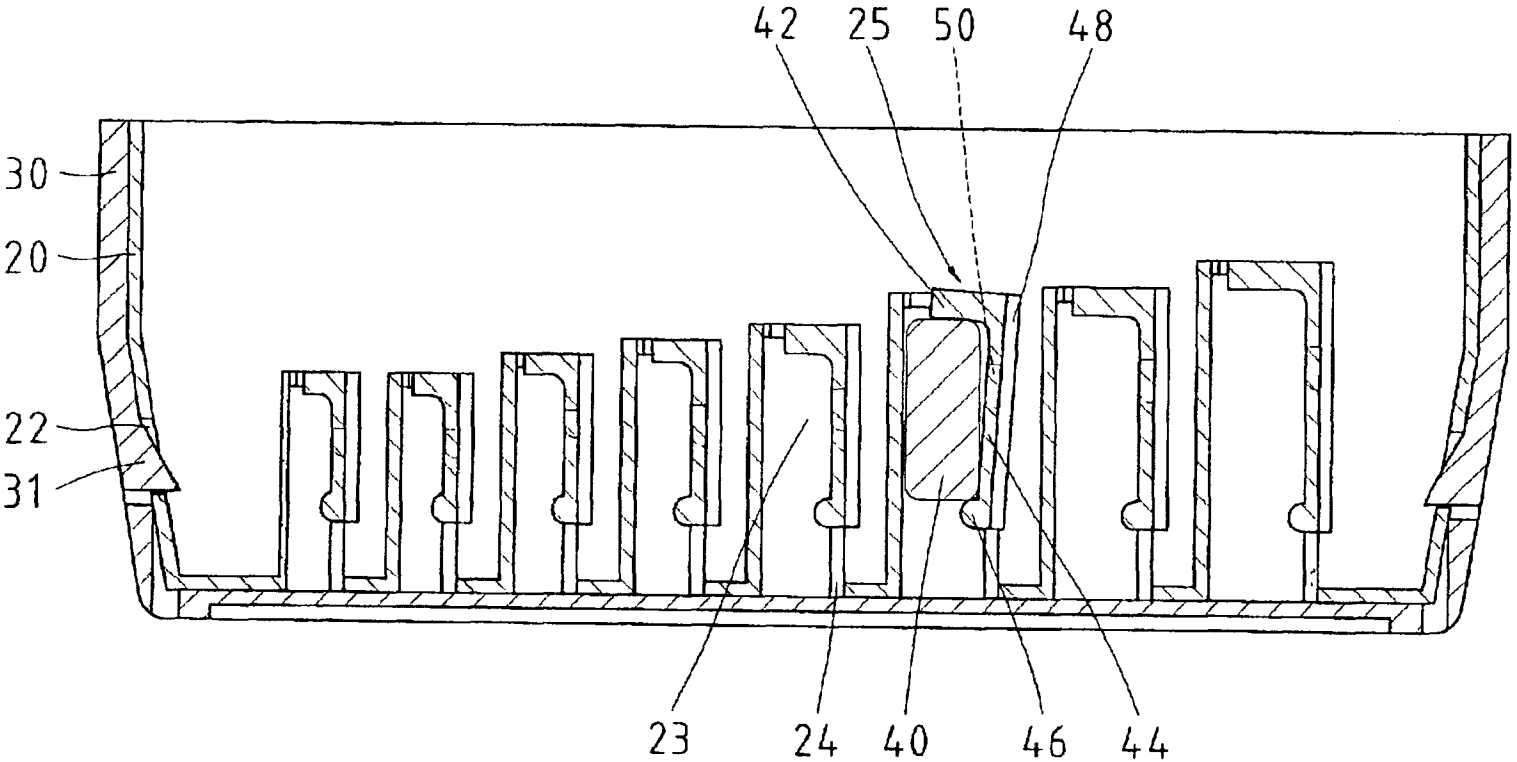
FIG. 6 is a cross-sectional view taken along a line 6—6 in FIG. 1.
Figure 7:
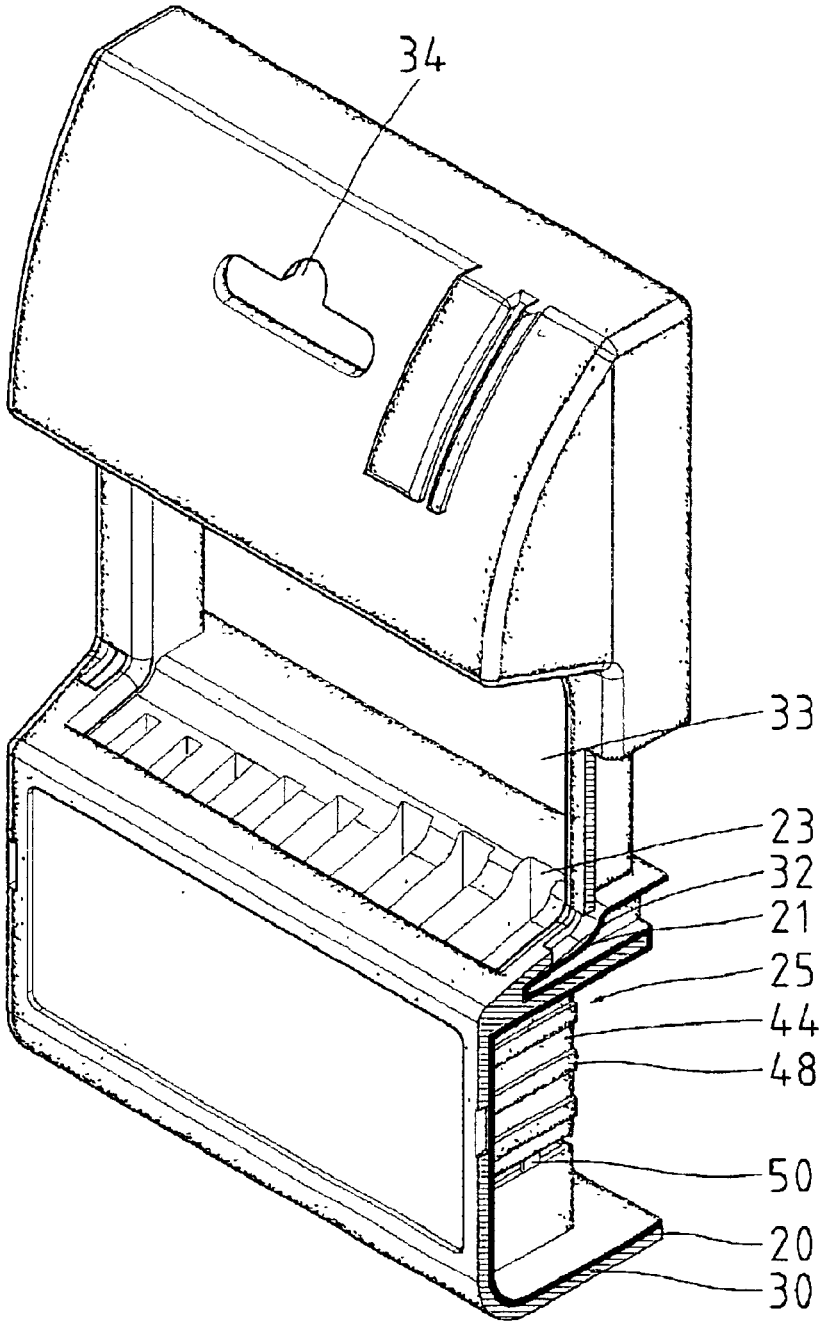
FIG. 7 is a cross-sectional view taken along a line 7—7 in FIG. 1.

Referring to FIGS. 6 and 7, when the wrench 40 is inserted in one of the recesses 23, the board 20 is inserted in the lower portion of the cover 30. The rods 21 are inserted in the holes 32. The hooks 31 are inserted in the holes 22, thus retaining the board 20 on the cover 30.

Figure 8:
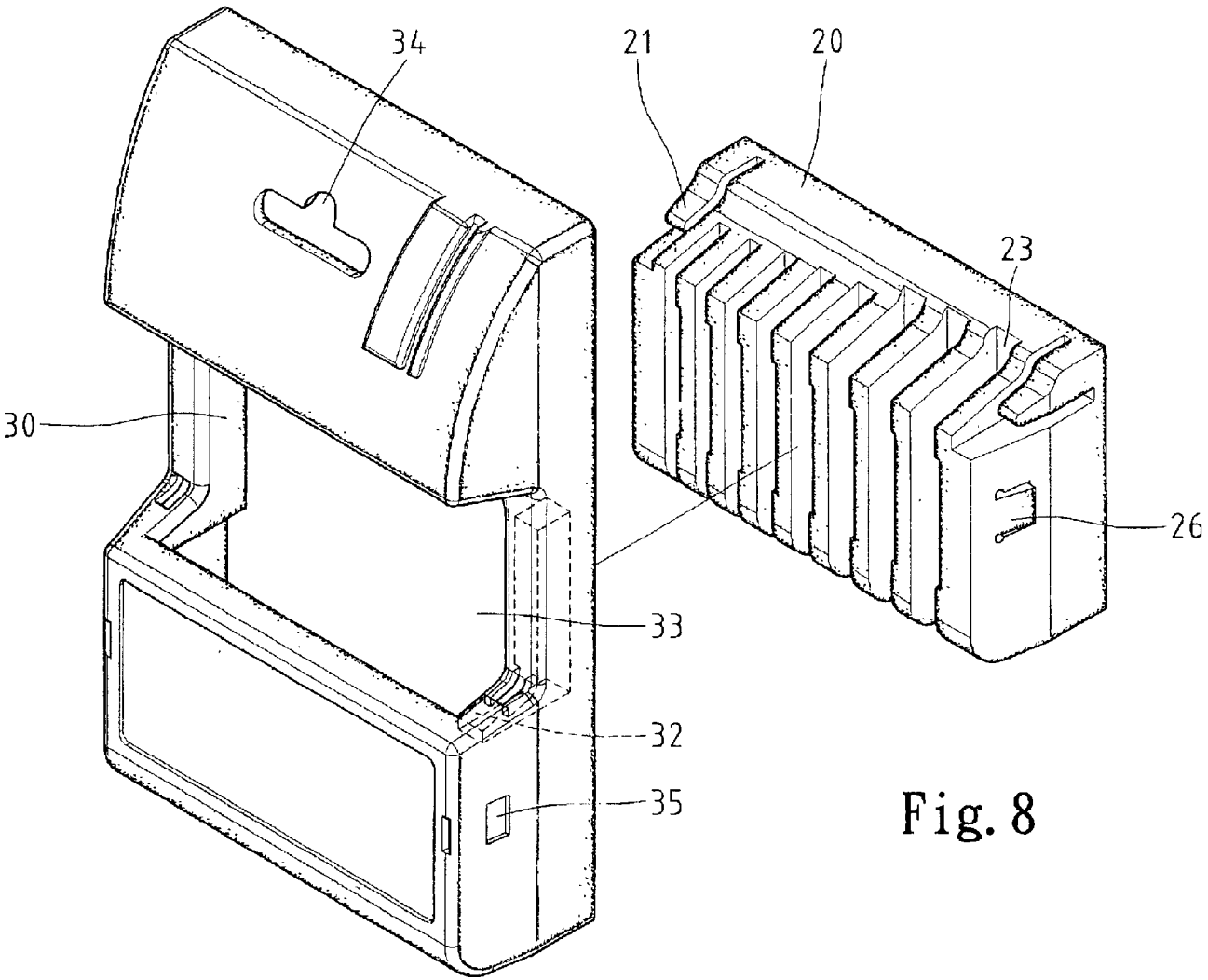
FIG. 8 is a perspective view of a hanger for wrenches according to a second embodiment of the present invention.

FIG. 8 shows a hanger according to a second embodiment of the present invention. The second embodiment is different from the first embodiment in that each of the sidewalls of the lower portion of the cover 30 includes a hole 35 instead of the hook 31 and that each of the sides of the board 20 includes a hook 26 instead of the hole 22.

The present invention has been described via illustration of some embodiments. After a study of this specification, those skilled in the art can derive various variations from the embodiments. Therefore, the embodiments are only taken as examples and shall not limit the scope of the present invention defined in the following claims.

What is claimed is:

1. A hanger for holding at least one wrench, the hanger including:

a board including at least one recess defined in a front face, wherein the at least one recess is defined between two sidewalls one of which defines a hole, wherein the hole defined in the one of the sidewalls includes an upper edge and a lower edge; and at least one holder including an upper edge integrally connected via a joint with the upper edge of the hole defined in the one of the sidewalls, with the at least one holder including a lower edge integrally connected with the lower edge of the hole defined in the one of the sidewalls, with the at least one holder formed as a single element with the one of the sidewalls and being elastically and pivotally mounted on the board for holding a wrench in the at least one recess.

2. The hanger according to claim 1 wherein the at least one holder includes a stop formed thereon for restricting the wrench.

3. A hanger for holding at least one wrench, the hanger including:

a board including at least one recess defined in a front face, with the board including at least one holder elastically and pivotally mounted thereon for holding a wrench in the at least one recess, and with the board including two holes each defined in a side of the board; and a cover for covering the board, the cover including two hooks each formed in a sidewall for insertion in the holes of the board for retaining the board engaged with the cover, with the sidewalls of the cover being slideable upon and abutting with the sides of the board, with each of the hooks located in a U-shaped slit in the cover and around the hook allowing the hook to flex relative to the cover.

4. The hanger according to claim 3 wherein the at least one holder includes a stop formed thereon for restricting the wrench.

5. The hanger according to claim 3 wherein the at least one recess is defined between two sidewalls on one of which the at least one holder is mounted.

6. The hanger according to claim 3 wherein the at least one recess is defined between two sidewalls one of which defines a hole in which the at least one holder is located.

7. The hanger according to claim 6 wherein the hole defined in the one of the sidewalls includes an upper edge and a lower edge, and the at least one holder includes an upper edge connected with the upper edge of the hole defined in the one of the sidewalls and a lower edge connected with lower edge of the hole defined in the one of the sidewalls.

8. The hanger according to claim 7 including a joint via which the upper edge of the at least one holder is connected with the upper edge of the hole defined in the one of the sidewalls.

9. The hanger according to claim 8 wherein the joint is integrally formed as a single element between the upper edge of the at least one holder and the upper edge of the hole defined in the one of the sidewalls.

10. The hanger according to claim 7 including a joint via which the lower edge of the at least one holder is connected with the lower edge of the hole defined in the one of the sidewalls.

11. The hanger according to claim 10 wherein the joint is integrally formed as a single element between the lower edge of the at least one holder and the lower edge of the hole defined in the one of the sidewalls.

12. The hanger according to claim 3 wherein the board includes at least one rod extending from a face thereof parallel to and spaced from the at least one recess, and the cover includes at least one hole defined in a face thereof for receiving the at least one rod.

13. A hanger for holding at least one wrench, the hanger including:

a board including at least one recess defined in a front face thereof, with the board including at least one holder formed thereon in the at least one recess for elastically holding a wrench in the at least one recess, and with the board including two hooks each formed on a side thereof, with each of the hooks located in a U-shaped slit in the board and around the hook allowing the hook to flex relative to the board; and a cover covering the board and including two holes defined therein for receiving the hooks of the board for retaining the board engaged with the cover, with the sidewalls of the cover being slideable upon and abutting with the sides of the board.

14. The hanger according to claim 13 wherein the board includes at least one rod extending from a face thereof parallel to and spaced from the at least one recess, and the cover includes at least one hole defined in a face thereof for receiving the at least one rod.

15. The hanger according to claim 13 wherein the at least one holder includes a stop formed thereon for restricting the wrench.

16. The hanger according to claim 13 wherein the at least one recess is defined between two sidewalls on one of which the at least one holder is mounted.

17. The hanger according to claim 13 wherein the at least one recess is defined between two sidewalls one of which defines a hole in which the at least one holder is located.

18. The hanger according to claim 17 wherein the hole defined in the one of the sidewalls includes an upper edge and a lower edge, and the at least one holder includes an upper edge connected with the upper edge of the hole defined in the one of the sidewalls and a lower edge connected with lower edge of the hole defined in the one of the sidewalls.

19. The hanger according to claim 18 including a joint via which the upper edge of the at least one holder is connected with the upper edge of the hole defined in the one of the sidewalls.

20. The hanger according to claim 19 wherein the joint is integrally formed as a single element between the upper edge of the at least one holder and the upper edge of the hole defined in the one of the sidewalls.

* * * * *